US007661671B2

(12) United States Patent
Yamazaki et al.

(10) Patent No.: US 7,661,671 B2
(45) Date of Patent: Feb. 16, 2010

(54) SHEET STACKING APPARATUS AND SHEET STACKING METHOD

(75) Inventors: Hiroyuki Yamazaki, Haibara-gun (JP); Yoshikazu Hanada, Haibara-gun (JP); Sumio Iwamura, Haibara-gun (JP); Makoto Endo, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 12/203,975

(22) Filed: Sep. 4, 2008

(65) Prior Publication Data

US 2009/0057983 A1 Mar. 5, 2009

(30) Foreign Application Priority Data

Sep. 5, 2007 (JP) ..... 2007-230608
Feb. 29, 2008 (JP) ..... 2008-049874

(51) Int. Cl.
*B65H 31/00* (2006.01)

(52) U.S. Cl. ..... 271/211; 271/223

(58) Field of Classification Search ..... 271/207, 271/211, 223, 224, 218
See application file for complete search history.

(56) References Cited

U.S. PATENT DOCUMENTS 5,374,051 A * 12/1994 Ulrich et al. ..... 271/222
5,709,382 A * 1/1998 Shima ..... 271/209
7,125,216 B2 * 10/2006 Grewe et al. ..... 414/790.8
7,384,037 B2 * 6/2008 Sawayama et al. ..... 271/207

FOREIGN PATENT DOCUMENTS

JP 2002-46924 A 2/2002

* cited by examiner

*Primary Examiner*—Kaitlin S Joerger
(74) *Attorney, Agent, or Firm*—Sughrue Mion, PLLC

(57) ABSTRACT

In a sheet stacking apparatus, a pair of side members includes a pair of lower side members which is provided with an approximately same distance therebetween as a width of a planographic printing plate and limits a movement in the planographic printing plate width direction; and a pair of upper side members which are provided above the pair of lower side members, each of which is provided with a movable section movable in the planographic printing plate width direction, and on which tapered surfaces are formed facing each other in a generally V shape. The distance between the pair of upper side members is controlled by driving the movable sections of the pair of upper side members so as to prevent quality degradation caused by a thrown-in sheet scratching a stacked sheet.

10 Claims, 5 Drawing Sheets

SHEET STACKING APPARATUS AND SHEET STACKING METHOD

BACKGROUND OF THE INVENTION

1. Field of the Invention

The present invention relates to a sheet stacking apparatus and a sheet stacking method, and more particularly relates to a sheet stacking apparatus which positions each of a plurality of sheets sequentially thrown in from a conveying device at a predetermined stacking position and stacks these sheets in layers; and a sheet stacking method using the sheet stacking apparatus.

2. Description of the Related Art

In a processing line of a planographic printing plate, a planographic printing sheet to which a protection sheet is attached is cut into a product size, and the like. Then, the planographic printing plate is placed on a conveying unit such as a belt conveyor, a roller conveyor, and the like, and conveyed, by the conveying unit, to a stacking apparatus of the planographic printing plate provided at the end of the processing line. The stacking apparatus is provided with, for example, a stacking platform for receiving the planographic printing plate thrown in above from the conveying unit; and a back member, a front member, and a pair of side members for positioning planographic printing plates sequentially thrown in onto the stacking platform at a predetermined stacking position respectively.

The back member is elastically supported by a coil spring or the like and is arranged so as to face the front end of the planographic printing plate on the stacking surface. When a planographic printing plate is thrown in from the conveying unit onto the stacking surface, the back member elastically receives the front end of the planographic printing plate which tries to move in the conveying direction by the inertia thereof, limits the movement of the planographic printing plate in the conveying direction, and urges the planographic printing plate in a direction opposite to the conveying direction as needed. In addition, the front member is arranged so as to face the back end of the planographic printing plate on the stacking surface, comes in contact with the planographic printing plate whose movement in the conveying direction is limited or which is urged in a direction opposite to the conveying direction by the back member, and positions the planographic printing plate along the longitudinal direction thereof.

A pair of side members is arranged so as to face each of the both ends of the planographic printing plate on the stacking surface. Each of the side members is formed of a plate material having enough high strength such as a thick steel plate. The pair of side members includes: an inclined guide surface which is provided at the upper side thereof, and is inclined with respect to the height direction; and a positioning surface which is provided at the lower side thereof, and is formed along the height direction. Therefore, the planographic printing plate stacked on the stacking platform is positioned near the center position between the pair of side members facing each other.

Accordingly, when the conveying unit sequentially throws in a plurality of planographic printing plates onto the stacking surface of the stacking apparatus, the planographic printing plates are positioned at predetermined stacking position on the stacking surface by the front member and the pair of side members and are stacked in layers. At this time, when the number of planographic printing plates on the stacking surface reaches a predetermined number for one stack bundle defined by a shipping specification and the like, the predetermined number of planographic printing plates are transshipped as a stack bundle from the stacking apparatus to a pallet or the like, and the bundle is conveyed to packaging and shipping processes or a storage warehouse or the like.

For example, Japanese Patent Application Laid-Open No. 2002-046924 discloses such a stacking apparatus that can align the side ends of planographic printing plates stacked on the stacking platform without causing the planographic printing plates to be stuck or deformed around side ends thereof, when the planographic printing plates are thrown in from the conveying device to the stacking platform. In the stacking apparatus, an elastic member can be elastically deformed along the width direction of the planographic printing plate and is supported so as to be in contact with the side end surface of the planographic printing plate thrown in from the conveying device. And, if the planographic printing plate thrown in from the conveying device is shifted away from a predetermined width position along the width direction, the elastic member urges the planographic printing plate to the predetermined width position side so as to position the planographic printing plate having been stacked on the stacking surface at the predetermined width position. In such a configuration of the back member of the stacking apparatus, the planographic printing plates sequentially thrown in from the conveying device can be positioned with good precision by the elastic member while the planographic printing plate is dropping onto the stacking surface or immediately after the planographic printing plate has been stacked on the stacking surface. Accordingly, a plurality of planographic printing plates thrown in from the conveying device can be stacked on the stacking surface such that the side ends of the planographic printing plate are matched with each other.

SUMMARY OF THE INVENTION

However, the stacking apparatus disclosed by Japanese Patent Application Laid-Open No. 2002-046924 has a problem in that when a sheet is stacked, the front end portion of the sheet hits against the back member and the sheet is curved and deformed into a mountain-like shape (an arcuate curl occurs), which may hit against the next coming sheet. In addition, when the sheet is stacked, air remains under the bottom surface (rear surface) of the sheet. For that reason, the center portion of the sheet drops later than the end portions thereof and an arcuate curl occurs. As a result, the end of the sheet may scratch the surface of a sheet stacked on the stacking surface. In particular, with the recent progress in CTP (computer-to-plate) of planographic printing plates, the film surface strength of a photosensitive layer is getting weaker than that of the conventional planographic printing plate. In addition, in order to reduce environmental load, a planographic printing plate without a slip sheet placed on the surface of the photosensitive layer may be stacked. In that case, if the aforementioned curl occurs, the planographic printing plate may easily scratch the printing form surface of another planographic printing plate, which is undesirable for a product.

The present invention has been made to solve the above problems and an object of the present invention is to provide a sheet stacking apparatus and a sheet stacking method which can prevent a sheet such as a thrown-in planographic printing plate from scratching a stacked sheet thereby avoiding quality degradation caused by the scratching.

In order to achieve the aforementioned object, according to a first aspect of the present invention, a sheet stacking apparatus for positioning each of a plurality of sheets sequentially thrown in from a conveying device at a predetermined stacking position and stacking the sheets in layers, the sheet stacking apparatus includes: a stacking platform having a stacking surface on which the sheet thrown in from the conveying device is placed and a plurality of the sheets are stacked; a front member which is provided at the conveying device side of the stacking platform and is provided with an air blowing device for forming an air flow in the sheet conveying direction under the sheet thrown in from the conveying device; a back member which is provided at a back side of the stacking platform, comes in contact with a front end of the sheet thrown in from the conveying device, and receives the sheet so as to be stacked on the stacking platform; and a pair of side members provided facing each other outside the stacking platform in a width direction thereof. And, sheet stacking apparatus, the pair of side members are provided with: a pair of lower side members which is provided with an approximately same distance therebetween as the sheet width and limits a movement in the sheet width direction; a pair of upper side members which is provided above the pair of lower side members, each of which is provided with a movable section movable in the sheet width direction, and on which tapered surfaces are formed facing each other in a generally V shape; and a control device which controls a distance between the pair of upper side members by driving the movable sections of the pair of upper side members.

According to the sheet stacking apparatus configured as described above, since the distance between the pair of upper side members can be controlled, the thrown-in sheet can be received so as to be placed between the pair of tapered surfaces and then the distance between the pair of upper side members is gradually extended so as to allow a center portion of the sheet to be bent by its own weight. This bending increases the sheet rigidity; thereby the front end portion of the thrown-in sheet does not droop downward. The bending state is maintained until the sheet comes in contact with the back member. If the distance between the pair of upper side members is extended to or more than the sheet width immediately before the sheet comes in contact with the back member, the sheet drops toward the stacking platform with the center portion in a concavely bent state (U-shape) with respect to the stacking surface. This can prevent the front end portion of the sheet from downwardly drooping and can suppress the sheet drop velocity (dropping speed), thereby preventing the front end portion of the sheet from scratching the surface of a sheet stacked on the stacking surface.

According to a second aspect of the present invention, in the sheet stacking apparatus according to the first aspect, the tapered surfaces of the upper side member are inclined at an angle ranging from 25° or more to less than 65° with respect to the horizontal surface.

According to a second aspect of the present invention, in a case where the center line of a sheet sequentially thrown in from the conveying device is misaligned with the center line of the tapered surface facing each other, and the sheet is not placed evenly between the pair of tapered surfaces, if the angle of the tapered surfaces facing each other with respect to the horizontal surface is less than 25°, a correction force for correction so as to place the sheet evenly is difficult to occur. If the angle exceeds 65°, the sheet is placed on the upper end portions of the tapered surfaces facing each other and the distance to the stacking surface is increased. Therefore, the sheet may be inclined during dropping and may scratch a stacked sheet.

According to a third aspect of the present invention, in the sheet stacking apparatus according to the first aspect or the second aspect, the pair of lower side members has pawl members capable of projecting and retracting in the horizontal direction provided facing each other above the stacking surface.

According to the third aspect of the present invention, even if a sheet conveyed in a meander state is thrown in from the conveying device or is thrown in with the center line of the conveying direction shifted, and the sheet drops without being evenly placed between the tapered surfaces facing each other, it is possible to correct an inclination in the width direction and reliably position the sheet at a predetermined stacking position by tentatively receiving the sheet by the pawl members capable of projecting and retracting. If the pawl member is retracted after the correction, the sheet quietly drops by keeping an approximately horizontal state from above a predetermined stacking position, thereby reliably preventing quality degradation caused by the sheet scratching a stacked sheet.

A forth aspect of the present invention, the sheet stacking apparatus according to any one of the first to third aspects, further includes a pressing device which is provided above the stacking platform and blows air for pressing an approximately center portion of the sheet from above to the stacking platform side.

According to the forth aspect of the present invention, it is possible to increase the sheet rigidity by providing such a pressing device above the stacking platform to force the center portion of the sheet to be bent. In addition, forcing the center portion of the sheet to be bent can prevent air from remaining under the bottom surface (rear surface) of the sheet, thereby further suppressing an arcuate curl formed by a lifting of the center portion of the sheet, and preventing the sheet from scratching the surface of a stacked sheet.

According to the fifth aspect of the present invention, in the sheet stacking apparatus according to any one of the first to fourth aspects, the back member is formed in a slit shape for venting the airflow from the air blowing device.

According to the fifth aspect of the present invention, a slit is cut into the back member to create space for escaping air remained under the rear surface of the thrown-in sheet, thereby preventing air from remaining under the rear surface of the sheet. Accordingly, it is possible to further suppress an arcuate curl formed by the lifting of the center portion of the sheet, and prevent the sheet from scratching the surface of a stacked sheet.

A sixth aspect of the present invention, the sheet stacking apparatus according to any one of the first to fifth aspects, further includes a suction device which is provided near the back member at the back side of the stacking platform and absorbs the airflow from the air blowing device According to the sixth aspect of the present invention, the suction device provided near the back member at the back side of the stacking platform absorbs air remaining under the rear surface of the sheet. Accordingly, it is possible to further suppress an arcuate curl formed by the lifting of the center portion of the sheet, and prevent the sheet from scratching the surface of a stacked sheet.

According to the seventh aspect of the present invention, in the invention according to any one of the first to sixth aspects, the sheet is a planographic printing plate.

The sheet stacking apparatus in accordance with the present invention is particularly effective if a planographic printing plate is used as the sheet, and can prevent the planographic printing plate from scratching the photosensitive layer surface (printing form surface) of a stacked planographic printing plate. Accordingly, the sheet stacking apparatus is economical since the planographic printing plates can be stacked without a slip sheet.

In order to achieve the aforementioned object, according to an eighth aspect of the present invention, in a sheet stacking method for positioning each of a plurality of sheets sequentially thrown in from a conveying device at a predetermined stacking position and stacking the sheets in layers using the sheet stacking apparatus according to any one of the first to seventh aspects, the control device stacks sheets in layers on the stacking surface of the stacking platform by repeating: a first step of controlling the distance between the pair of upper side members so that, immediately after a sheet is thrown in from the conveying device, the distance between the lower ends of the pair of tapered surfaces is narrower than the sheet width, and placing the thrown-in sheet between the pair of tapered surfaces; a second step of controlling the distance between the pair of upper side members so as to be gradually extended as the sheet advances in a direction toward the back member by the inertia of the thrown-in sheet and the airflow from the air blowing device, and allowing a center portion of the sheet placed between the pair of tapered surfaces to be bent downward by its own weight; and a third step of controlling the distance between the lower ends of the pair of tapered surfaces so that the distance becomes wider than the sheet width when the sheet advances immediately before being in contact with the back member, and dropping the sheet.

The eighth aspect provides the detailed steps for the sheet stacking method for positioning a plurality of sheets sequentially thrown in from the conveying device at a predetermined stacking position respectively and stacking the sheets in layers using the sheet stacking apparatus according to any one the first to seventh aspects, and the control device for the apparatus repeats the first to third steps to reliably prevent quality degradation caused by the thrown-in sheet scratching a stacked sheet.

According to a ninth aspect, the sheet stacking method according to the eighth aspect of the present invention, further includes a fourth step of projecting the pawl members facing each other from the pair of lower side members before the sheet is dropped and stacked in the third step; receiving the dropping sheet; retracting the pawl members; and dropping the sheet again onto the stacking surface.

According to the ninth aspect, as described in the third aspect, it is possible to further reliably prevent quality degradation caused by the sheet scratching a stacked sheet.

According to a tenth aspect, in the sheet stacking method according to the eighth aspect or the ninth aspect, the third step uses a suction operation by a suction device as well for absorbing the airflow from the air blowing device.

According to the tenth aspect, the third step uses a suction operation by a suction device as well for absorbing the airflow from the air blowing device, thereby preventing air from remaining under the rear surface of the sheet. Accordingly, it is possible to further suppress an arcuate curl formed by a lifting of the center portion of the sheet, and further prevent the sheet from scratching the surface of a stacked sheet.

As described above, the present invention can provide a sheet stacking apparatus and a sheet stacking method capable of preventing quality degradation caused by a thrown-in sheet scratching a stacked sheet.

DETAILED DESCRIPTION OF THE PREFERRED EMBODIMENTS

Hereinafter, a preferred embodiment of the sheet stacking apparatus and the sheet stacking method in accordance with the present invention will be described in detail with reference to drawings. It should be noted that the planographic printing plate will be used as an example of the sheet in the following embodiment.

First, description will be given to a planographic printing plate processing line 10 for a planographic printing plate stacking apparatus in accordance with an embodiment of the present invention shown in FIGS. 1 and 2.

Figure 1:
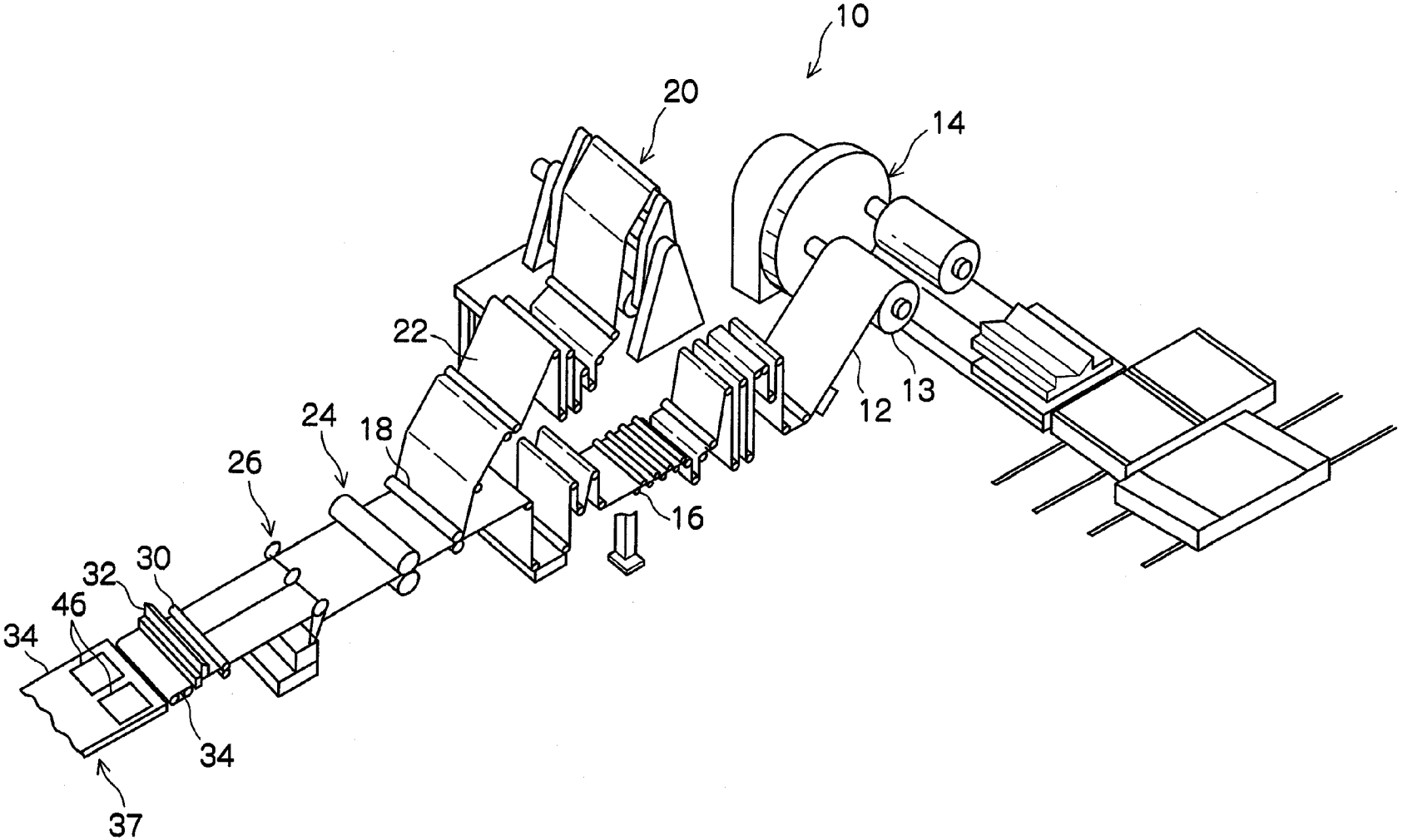
FIG. 1 is a perspective view showing a schematic configuration of a processing line for a stacking apparatus of a planographic printing plate in accordance with an embodiment of the present invention.

As shown in FIG. 1, a web feeder 14 is provided at the upstream side (upper right side of FIG. 1) of the processing line 10. A web 12, which is used as a material of the planographic printing plate, is wound on a web roll 13, and the web roll 13 is removably attached to the web feeder 14. The web feeder 14 sends the web 12 from the web roll 13 toward the downstream in a continuous manner at a speed corresponding to a line speed of the processing line 10. The web 12 passes through a leveler 16, where a curl thereof is corrected, and reaches a pressure-bonding roller 18. The pressure-bonding roller 18 pressure-bonds a strip-shaped slip sheet 22 sent from a slip sheet feeder 20 to the top surface (photosensitive layer surface) of the web 12. At this time, the slip sheet 22 pressure-bonded to the web 12 is charged by a charging device (not shown) and is electrostatically bonded to the web 12.

A notcher 24 is provided at the downstream side of the pressure-bonding roller 18. When the slit width of the web 12 is changed, the notcher 24 punches out the web 12 at the center and at both side ends along the width direction thereof respectively to form cutouts (notches) having a predetermined shape on the web 12 at the center and at both side ends thereof. By this, cutting blades 26 (see FIG. 2) of the slitter 26 provided so as to correspond to the center and both side ends of the web 12 respectively can be movable in the axial direction inside the notch and thereby, the width of the web 12 can be changed while the web 12 and the slip sheet 22 can be cut at the same time and in a continuous manner.

The web 12 is cut into a predetermined slit width by the slitter 26 and the feed length thereof is counted by the length measuring device 30. When a count value by the length measuring device 30 reaches a predetermined count value, the web 12 is cut synchronously therewith along the web width direction by the flying cutter 32. This allows the planographic printing plate 46 to be manufactured with a predetermined product size. The planographic printing plates 46 cut from the web 12 are placed on a conveying unit 37 consisting of a plurality of belt conveyors 34 and 42 as shown in FIG. 2. The web 12 is conveyed to the downstream by the conveying unit 37 and is thrown in a stacking apparatus 50 by the belt conveyor 42 provided at the end of the conveying unit 37.

Here, as shown in FIG. 1, the web 12 is divided into two sheets along the width direction by the slitter 26 and the two planographic printing plates 46 are simultaneously cut by the flying cutter 32. In this case, the simultaneously cut two planographic printing plates 46 are sorted to two separate belt conveyors 42 respectively by a sorting gate or the like provided while being conveyed to the stacking apparatus 50 and are thrown in the two separate stacking apparatuses 50, each provided in a different place, by these belt conveyors 42.

In addition, the sorting gate 40 for switching the conveying destination of the planographic printing plate 46 is provided between the belt conveyor 34 and the belt conveyor 42. If one of the planographic printing plates 46 cut from the web 12 is a sample product or a defective product, the planographic printing plate 46 is sorted to a belt conveyor 36 for a lineout by the sorting gate 40 and is thrown in the collection box 44 by the belt conveyor 36.

Figure 3:
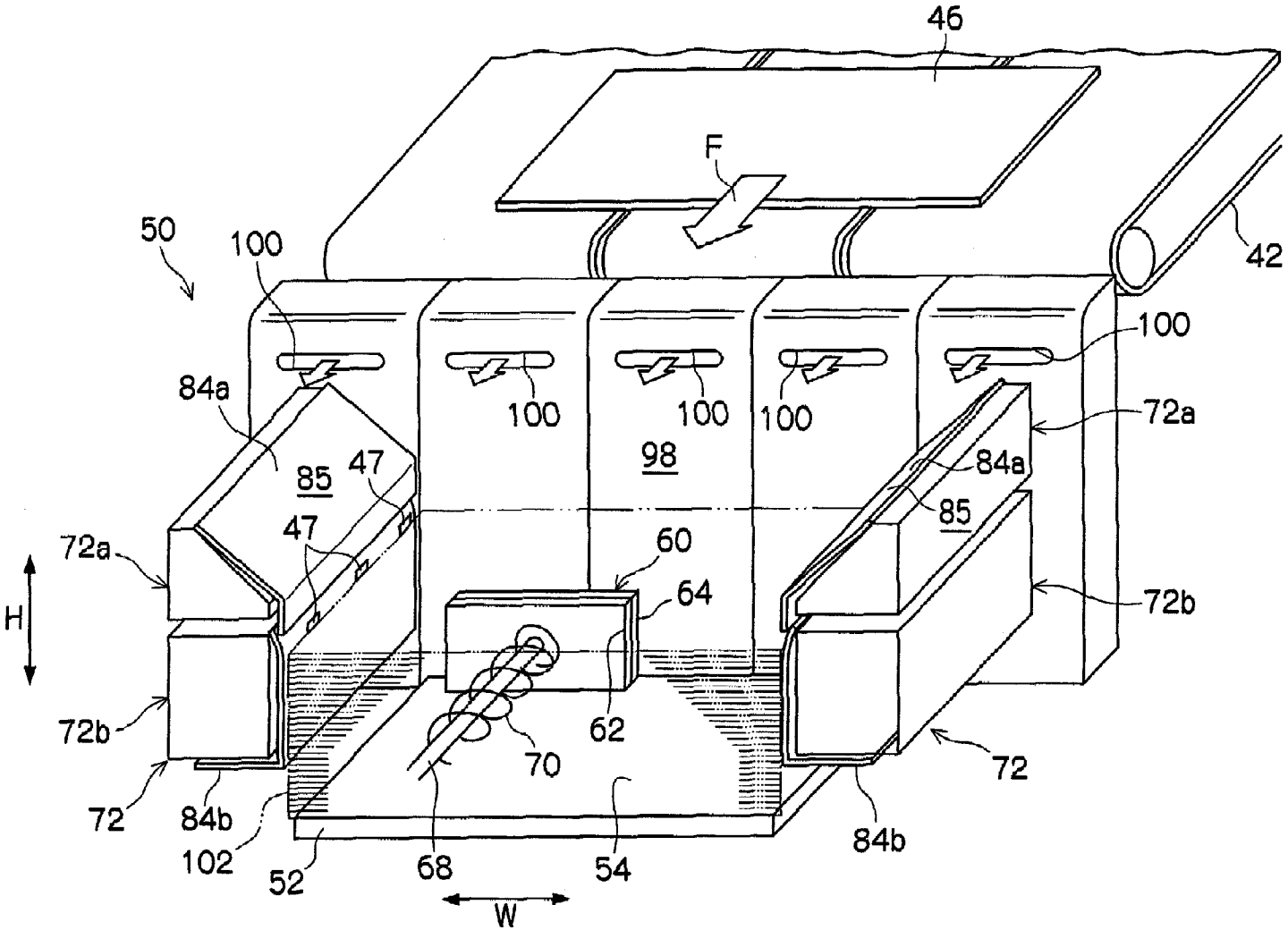
FIG. 3 is a perspective view showing a configuration of the stacking apparatus of the planographic printing plate in accordance with the embodiment of the present invention.

FIG. 3 shows the planographic printing plate stacking apparatus 50 (hereinafter referred to simply as "stacking apparatus 50") in accordance with the embodiment of the present invention. The stacking apparatus 50 is for stacking a plurality of planographic printing plates 46 sequentially thrown in from the end of the belt conveyor 42, so that the planographic printing plates 46 are aligned to a predetermined stacking position and stacked in layers.

A flat stacking platform 52 is provided in the stacking apparatus 50 at the downstream side in the conveying direction (in the arrow F direction in FIG. 3) of the belt conveyor 42. The top surface of the stacking platform 52 is a flat stacking surface 54 on which the planographic printing plates 46 are stacked. In addition, the stacking platform 52 is supported by a lifter 56 as shown in FIG. 2. The lifter 56 moves up and down the stacking platform 52 in the thickness direction of the planographic printing plates 46 so as to always maintain the height of the uppermost planographic printing plate 46 at a constant level according to a detection signal from a level sensor (not shown) for detecting the height of the uppermost planographic printing plate 46 stacked on the stacking surface 54.

Figure 2:
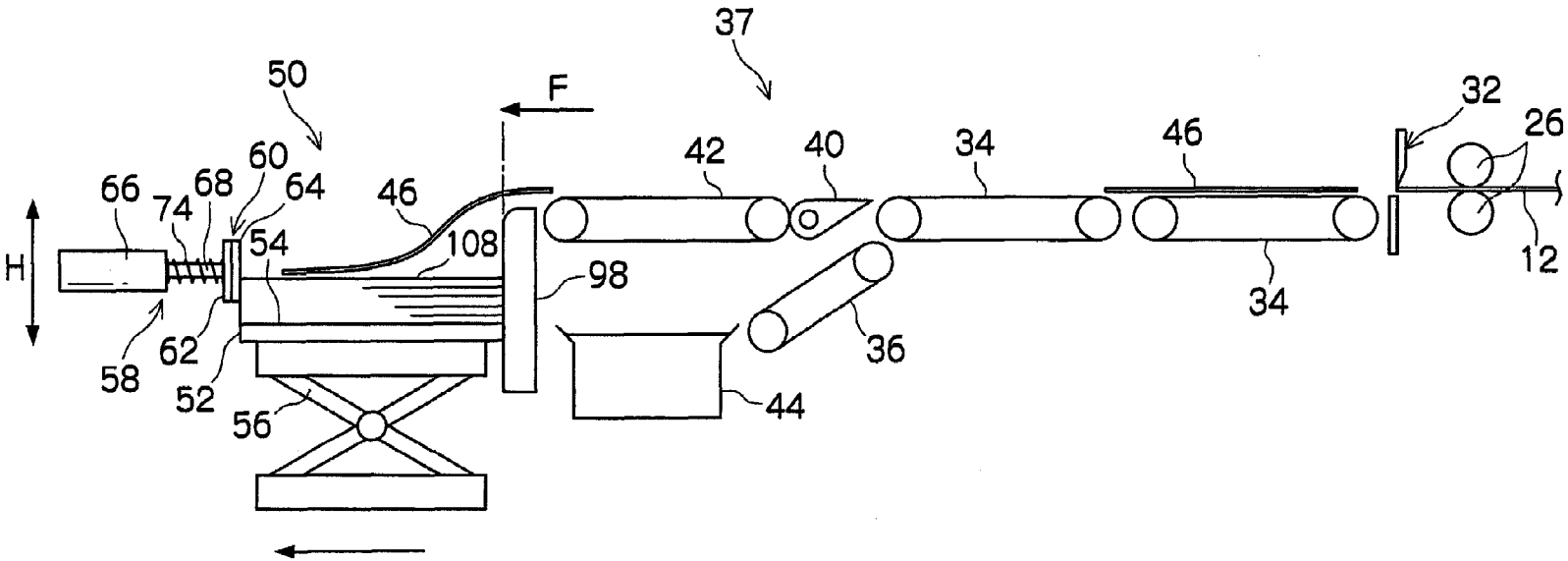
FIG. 2 is a configuration diagram showing the schematic configuration of the processing line for the stacking apparatus of the planographic printing plate in accordance with the embodiment of the present invention.

A pair of back members 58 is provided in the stacking apparatus 50 at the downstream side of the stacking platform 52 along the conveying direction as shown in FIG. 2. A stopper plate 60 is provided on each of the back members 58 so as to face the front surface of the planographic printing plates 46 stacked on the stacking surface 54. The stopper plate 60 is supported such that the width direction thereof is approximately parallel to the conveying direction. As shown in FIG. 2, a base section 62 consisting of a metal plate or a plastic plate is provided at a base end section of the stopper plate at the opposite side of the stacking platform 52. The front surface of the base section 62 at the side of the stacking platform 52 is covered with a pad-like cushioning material 64.

As shown in FIG. 2, a cylinder 66 is provided on the back member 58 to support the stopper plate 60 and to cushion the shock from the planographic printing plate 46. The cylinder 66 is provided at the downstream side of the stopper plate 60 in the conveying direction and is fixed to a frame, a floor, or the like of the processing line 10 through a bracket (not shown) so as not to change the positional relation with respect to the belt conveyor 42. The cylinder 66 slidably supports a rod 68 along the conveying direction. The front end of the rod 68 in the cylinder 66 is connected and fixed to the base section 62 of the stopper plate 60. In addition, a coil spring 70 in a compressed state is provided on the peripheral side of the rod 68. The coil spring 70 always urges the stopper plate 60 in a direction opposite to the conveying direction. Here, the cylinder 66 is positionally adjustable along the conveying direction. Thereby, the position along the conveying direction of the stopper plate 60 is adjustable according to the length of the planographic printing plate 46 along the conveying direction stacked on the stacking platform 52.

Figure 4:
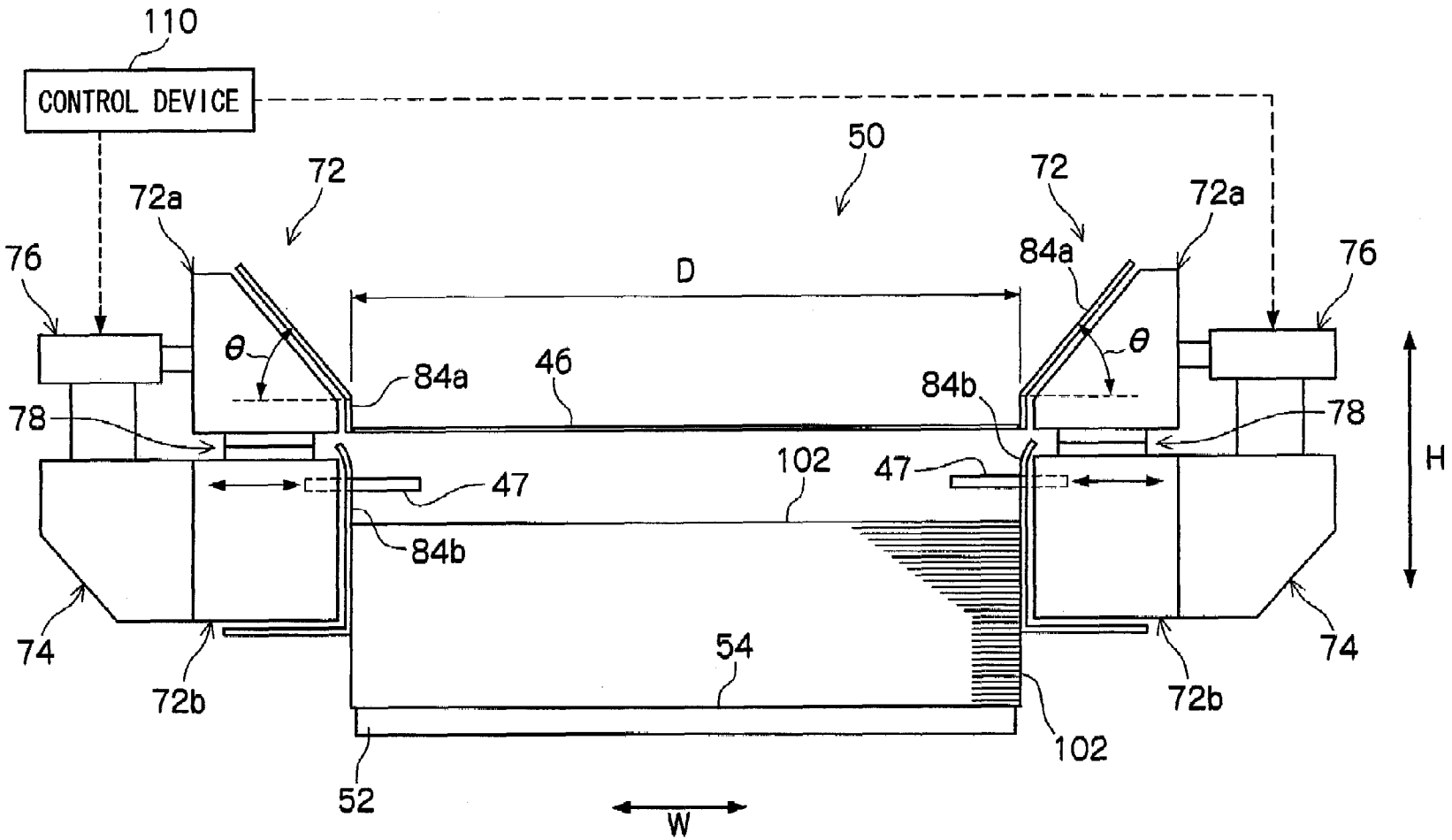
FIG. 4 is a front view showing the configuration of the stacking apparatus of the planographic printing plate in accordance with the embodiment of the present invention.

As shown in FIG. 3, the stacking apparatus 50 is provided with side members 72 which are provided outside of both (left and right) end faces of the stacking platform 52. As shown in FIGS. 3 and 4, the side members 72 are provided with the approximately same distance therebetween as the width of the planographic printing plate 46. The side members 72 comprise a pair of lower side members **72*b* for limiting the movement of the planographic printing plate 46 in the width direction and a pair of upper side members 72*a* which is provided above the pair of lower side members 72*b*, each of which is provided with a movable section movable in the sheet width direction and on which tapered surfaces 85 are formed facing each other in a generally V shape. As shown in FIG. 4, the tapered surfaces 85 of the upper side member 72*a*** are preferably inclined at an angle ranging from 25° or more to less than 65° with respect to the horizontal surface.

In addition, as shown in FIG. 4, the upper side member **72*a* and the lower side member 72*b* are fixed to a frame fixing member 74. The frame fixing member 74 can move up and down depending on the degree of the planographic printing plate 46 thrown therein from the belt conveyor 42. A cylinder 76 is attached to each of the upper side members 72*a*. The control device 110 controls the upper side members 72*a* so as to be moved along the width direction through slide members 78 provided between the upper side members 72*a* and the lower side members 72*b*. In addition, chassis like frame materials 84*a* and 84*b* are provided on the upper side members 72*a* and the lower side members 72*b* respectively. The frame materials 84*a* and 84*b* are formed of a stainless plate, a steel plate, and other thick plate material and have enough strength to stand the shock loading from the planographic printing plate 46 without deformation. In addition, the position of the side members 72 along the width direction is adjustable. Before the planographic printing plate 46 is thrown in from the belt conveyor 42, the side members 72 are adjusted to a position corresponding to the width of the planographic printing plate 46 along the width direction. The side members 72 are provided such that the width direction thereof matches the width direction (arrow W direction) of the planographic printing plate 46 stacked on the stacking platform 52 and the longitudinal direction thereof approximately matches the conveying direction of the planographic printing plate 46. The pair of the side members 72** has a symmetrical structure and a shape facing each other along the width direction.

In addition, as shown in FIGS. 3 and 4, a plurality of pawl members 47 capable of projecting and retracting in the horizontal direction are provided facing each other on the pair of lower side members **72*b* above the stacking surface 54. The projecting/retracting mechanism for projecting and retracting the pawl members 47 is not shown, but, for example, the inside of the lower side members 72*b* is hollowed out and holes for projecting are formed on the lower side members 72*b* and the frame materials 84*b*. Then, piston cylinders, stepper motors, cam mechanisms and the like are provided inside the hollowed lower side members 72*b* as the projecting/retracting mechanism. The timing of projecting or retracting the pawl members 47 may be controlled by using the aforementioned control device 110 to control the projecting/retracting mechanism. The timing of projecting the pawl members 47 is preferably immediately before the planographic printing plate 46 is dropped from the tapered surfaces 85 facing each other so as to receive the dropping planographic printing plate 46. In addition, the timing of retracting the pawl members 47 is preferably not immediately after the pawl members 47 receive the planographic printing plate 46, but after the planographic printing plate 46 received by the pawl member 47 stops vibrating and comes to rest. Then, the pawl members 47 are retracted so that the planographic printing plate 46 is made to drop again onto the stacking surface 54. The time for the planographic printing plate 46 to stop vibrating may be set to the control device 110** by obtaining it in advance by a test or the like and.

According to the present embodiment, as shown in FIG. 4, three (total of six) pawl members are provided on each lower side member 72*b* at intervals in the horizontal direction, but the number of pawl members may be two or more. It should be noted that the number of pawl members 47 may be enough to stably and tentatively receive the planographic printing plate 46 while the planographic printing plate 46 placed between the paired tapered surfaces 85 of the individual upper side members 72*a* facing each other is dropping onto the stacking surface 54. In addition, if it takes a long time from the time when the planographic printing plate 46 placed between the paired tapered surfaces 85 starts to drop until the pawl members 47 receive the planographic printing plate 46, the planographic printing plate 46 may be inclined during the dropping. Thus, the pawl members 47 are preferably provided on an upper end position of the lower side member 72*b* as much as possible. More specifically, the distance from the lower end of the tapered surface 85 to the pawl member 47 is preferably within a range from 10 to 30 mm. Though the pawl member 47 may be made up of metal, plastic resin, and other various materials, an especially preferred material is MC nylon since MC nylon is difficult to generate a defect such as a scratch on the planographic printing plate 46.

In addition, as shown in FIG. 3, the stacking apparatus 50 is provided with a front member 98 which is provided at the upstream side of the stacking platform 52 along the conveying direction. The front member 98 has an approximately rectangular shape and a thick plate shape, and is provided such that the thickness direction thereof matches the conveying direction and the longitudinal direction thereof matches the width direction of the stacking platform 52. The upper side surface of the front member 98 is a little lower than the top surface of the belt conveyor 42, and an end portion on the downstream side thereof is processed into an R shape and connected to the internal surface at the downstream side. In addition, the internal surface at the downstream side of the front member 98 is provided so as to position the planographic printing plate 46 along the conveying direction when the planographic printing plate 46 is thrown in onto the stacking platform 52 and is formed as a plane parallel to the height direction thereof. As shown in FIG. 3, a plurality of nozzle holes 100 having a slit shape elongated in the width direction are opened on the front member 98. The nozzle holes 100 are horizontally arranged respectively. An air pipe (not shown) is provided in the front member 98 to supply air to the plurality of nozzle holes 100. When the planographic printing plate 46 is stacked by the stacking apparatus 50, air is blown in the conveying direction from the plurality of nozzle holes 100. This enables the formation of an air layer between the planographic printing plate 46 and the stacking surface 54 or between planographic printing plates 46 immediately after the planographic printing plate 46 is thrown in from the belt conveyor 42, and the motion resistance of the planographic printing plate 46 moving (sliding) on the stacking surface 54 is suppressed by inertia.

Hereinafter, the operation and behavior of the stacking apparatus 50 configured as above will be described.

First, when the planographic printing plate 46 is thrown in onto the stacking platform 52 by the belt conveyor 42, the planographic printing plate 46 is placed on the stacking surface 54 while continuing to move in the conveying direction by inertia. At this time, air is sent from the nozzle hole 100 of the front member 98, and an air layer is formed along the bottom surface of the planographic printing plate 46 thrown in by the belt conveyor 42. The air layer suppresses the frictional resistance between the planographic printing plate 46 thrown in onto the stacking surface 54 and the stacking surface 54 or the stacked planographic printing plate 46, and the planographic printing plate 46 on the stacking surface 54 smoothly moves in the conveying direction. In addition, the lifter 56 (see FIG. 2) adjusts the position of the stacking surface 54 or the stacked planographic printing plate 46 to always maintain a constant height. This assures that the planographic printing plate 46 sequentially thrown in by the belt conveyor 42 lands in an approximately same position on the stacking surface 54 without being affected by the number of planographic printing plates 46 stacked on the stacking surface 54.

The planographic printing plate 46 thrown in from the belt conveyor 42 onto the stacking surface 54 continues to move in the conveying direction by inertia, and the front end surface comes in contact with the pair of back members 58. For that reason, the stopper plate 60 of the back member 58 receives a load corresponding to the weight and speed of the planographic printing plate 46. The stopper plate 60 which received a load from the planographic printing plate 46 moves in the conveying direction while compressively deforming the coil spring 70 and at the same time receives a damping force from the cylinder 66. This dissipates the kinetic energy of the planographic printing plate 46 and reduces a shock load acting as a reaction force from the back member 58 to the planographic printing plate 46. In addition, when the planographic printing plate 46 stops moving in the conveying direction, the back member 58 extends the rod 68 by a restoring force of the coil spring 70 and urges the planographic printing plate 46 in a direction toward the front member 98 opposite to the conveying direction through the stopper plate 60.

At the time when the planographic printing plate 46 receives an urging force from the back member 58, the air layer remains along the bottom surface of the planographic printing plate 46. For that reason, the planographic printing plate 46 receiving the urging force from the back member 58 smoothly moves on the stacking surface 54 in the direction toward the front member 98 and the back end surface thereof comes in contact with the front member 98. At this time, the back member 58 extends the rod 68 at an enough slow speed by the damping force from the cylinder 66 until the planographic printing plate 46 comes in contact with the front member 98. When the planographic printing plate 46 comes in contact with the front member 98, the back member 58 makes the stopper plate 60 come in contact with the planographic printing plate 46. Therefore, the planographic printing plate 46 is positioned at a position in contact with the front member 98 along the conveying direction.

However, only such an operation of the stacking apparatus 50 causes the following problem. When the planographic printing plate 46 is stacked, the front end portion of the planographic printing plate 46 hits against the stopper plate 60 of the back member 58 and the planographic printing plate 46 is curved and deformed into a mountain-like shape (an arcuate curl occurs), which may hit against the next coming planographic printing plate 46 and may scratch the surface of the planographic printing plate 46. In addition, when the planographic printing plate 46 is stacked, air remains under the planographic printing plate 46. For that reason, the center portion of the planographic printing plate 46 drops later than the end portions thereof and an arcuate curl occurs. As a result, the end portions of the planographic printing plate 46 may scratch the surface of the planographic printing plate 46 stacked on the stacking surface 54.

Further, when the planographic printing plate 46 meanders or the center line thereof is misaligned with the center line of the conveying direction while being conveyed by the belt conveyor 42, the center line of the planographic printing plate 46 in the conveying direction is misaligned with the center line of the tapered surfaces 85 facing each other. In that case, the planographic printing plate 46 is thrown into the stacking apparatus 50 in a misaligned state where the end portions of the planographic printing plate 46 in the width direction are not evenly placed (not properly balanced) between the paired tapered surfaces 85 facing each other. As a result, the planographic printing plate 46 may be inclined in the width direction when the planographic printing plate 46 drops toward the stacking surface 54.

In fact, not only the aforementioned end portions of the planographic printing plate 46 in the throwing-in direction but also the end portions in the sheet width direction may scratch the surface of a stacked planographic printing plate 46.

In view of this, according to the present invention, as described above, the pair of side members 72 are provided with: a pair of lower side members 72*b* which are provided with an approximately same distance therebetween as the width of the planographic printing plate 46 and limits the movement of the planographic printing plate 46 in the width direction; and a pair of upper side members 72*a* which are provided above the pair of lower side members 72*b*, each of which is provided with a movable section movable in the sheet width direction of the planographic printing plate 47, and on which the tapered surfaces 85 are formed facing each other in a generally V shape. In addition, provided is a control device 110 which controls the distance between the pair of upper side members 72*a* by driving the movable sections of the pair of upper side members 72*a*.

In addition, the angle θ of the tapered surfaces 85 of the paired upper side members 72*a* facing each other is determined as an angle ranging from 25° or more to less than 65° with respect to the horizontal surface, and the pair of lower side members 72*b* is provided with the pawl members 47 capable of projecting and retracting so that pawl members face each other.

Figure 5:
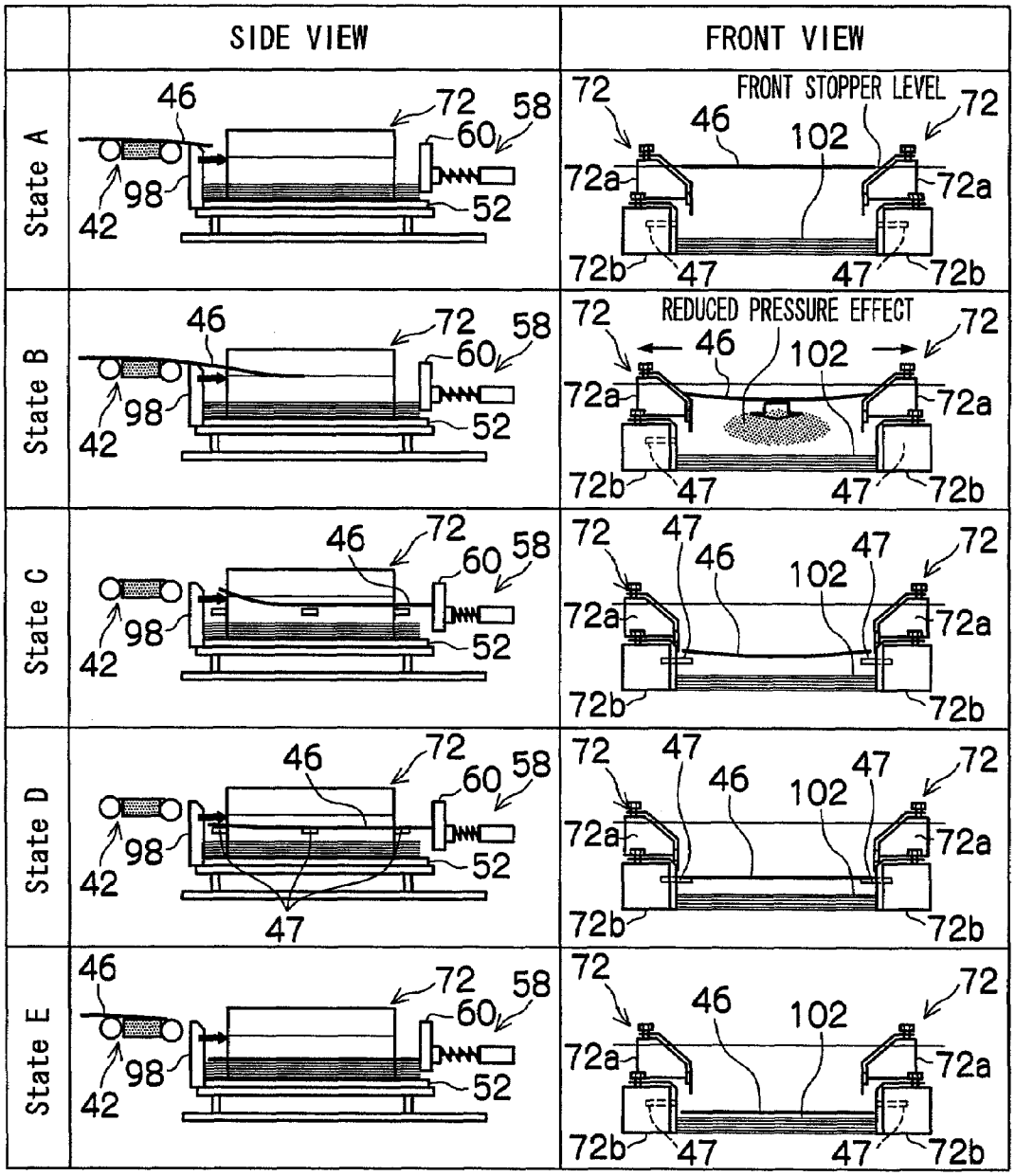
FIG. 5 is an explanatory drawing showing a stacking method of a planographic printing plate in accordance with an embodiment of the present invention.

FIG. 5 shows a stacking method by the stacking apparatus in accordance with the present invention, and in particular, shows an outline of the operation of the side members 72 and the behavior of a planographic printing plate related to the operation thereof.

State A of FIG. 5 shows a state when the planographic printing plate 46 is thrown onto the stacking platform 52 from the belt conveyor 42. Immediately after the planographic printing plate 46 is thrown in, the thrown-in planographic printing plate 46 is placed between the paired tapered surfaces 85 facing each other by controlling the distance between the paired upper side members 72*a* facing each other so that the distance between the paired lower sides of the tapered surfaces facing each other is narrower than the sheet width. When the planographic printing plate 46 is placed between the tapered surfaces 85, the angle θ thereof with respect to the horizontal surface is formed as 25° or more and less than 65°. If the angle of the tapered surfaces 85 facing each other with respect to the horizontal surface is less than 25°, a correction force is difficult to occur for correcting the planographic printing plate 46 so as to place the plate 46 evenly between the paired tapered surfaces 85 facing each other. If the tapered surfaces 85 is inclined at an angle from 25° or more to less than 65° with respect to the horizontal surface, even if the centerline in the conveying direction of the planographic printing plate 46 conveyed on the belt conveyor 42 and thrown in sequentially is misaligned with the centerline of the tapered surfaces 85 facing each other, a correction force is applied for correcting the misalignment of the centerlines when the planographic printing plate 46 is thrown in. For that reason, both left and right sides of the planographic printing plate 46 are placed evenly on the tapered surfaces 85 facing each other, thereby assuring that the planographic printing plate 46 is subsequently dropped and stacked normally. If the angle exceeds 65°, the planographic printing plate 46 is placed on the upper portions of the tapered surfaces 85 facing each other. Since the drop distance to the stacking surface 54 is increased, the planographic printing plate 46 may be inclined during dropping.

As shown in State B of FIG. 5, the planographic printing plate 46 travels in the direction toward the back member by the inertia of the throwing-in planographic printing plate 46 and an airflow from the air blowing device 100. At this time, the distance between the paired upper side members 72*a* facing each other is controlled so as to be gradually extended as the planographic printing plate travels. Then, the center portion of the planographic printing plate 46 placed between the tapered surfaces 85 facing each other is bent downward by its own weight. As described above, when the center portion of the planographic printing plate 46 placed between the tapered surfaces 85 facing each other is bent downward by its own weight, the rigidity of the planographic printing plate 46 is increased. Therefore, when the front end portion of the planographic printing plate 46 comes in contact with the stopper plate 60 of the back member 58, the front end portion of the planographic printing plate 46 does not droop downward.

Next, State C of FIG. 5 shows a state when the planographic printing plate 46 travels to a position immediately before coming in contact with the back member 58. At this time, control is made such that the distance between the paired lower ends of the tapered surfaces 85 is wider than the width of the planographic printing plate 46. Then, the planographic printing plate 46 drops toward the stacking surface 54 in a downwardly bent state. Immediately before the planographic printing plate 46 drops, the pawl members 47 project horizontally from the lower side members 72*b* facing each other over the stacking surface 54. Then, the pawl members 47 tentatively receive the dropping planographic printing plate 46. Even if the planographic printing plate 46 dropping from the tapered surfaces 85 facing each other is inclined left or right in the width direction thereof, the inclination can be corrected by the pawl members 47 capable of projecting and retracting which tentatively receive the planographic printing plate 46. For example, it is assumed that the planographic printing plate is placed unevenly between the tapered surfaces 85 facing each other and the angle θ of the aforementioned tapered surface 85 cannot correct the inclination. Then, the planographic printing plate 46 is dropped in a state inclined left or right in the width direction thereof. Even in that case, the pawl members 47 projecting horizontally can tentatively receive the planographic printing plate 46 to reliably correct the inclination. The planographic printing plate 46 received by the pawl members 47 has a shape where both end portions of the planographic printing plate 46 in the width direction are positioned at the same height and the center portion is a little bent downward. The downward bending of the planographic printing plate 46 at this time is not so large as that when placed between the tapered surfaces 85. In addition, since the planographic printing plate 46 is tentatively received by the pawl members 47, the position of the planographic printing plate 46 in the width direction is determined by the lower side members 72*b* formed to be approximately the same size as the width of the planographic printing plate 46. Accordingly, it is possible to reliably correct the inclination of the planographic printing plate 46 in the width direction and position the planographic printing plate 46 at a predetermined stacking position.

As shown in State E of FIG. 5, when the pawl members 47 are retracted in this state, the planographic printing plate 46 quietly drops by keeping an approximately horizontal state from above a predetermined stacking position. This can prevent the downward drooping of the front end portion of the planographic printing plate 46 in the throwing-in direction and the inclination thereof in the width direction, thereby reliably preventing the front end portion of the planographic printing plate 46 in the throwing-in direction and both end portions thereof in the width direction from scratching the surface of the stacked planographic printing plate.

It should be noted that the pair of tapered surfaces 85 is extended in the width direction in State C of FIG. 5, but when the planographic printing plate 46 drops through between the lower side members 72*b* and is placed on the stacking surface 54, the upper side members 72*a* are returned to the original positions (State E of FIG. 5).

Accordingly, the control device 110 of the stacking apparatus in accordance with the present invention repeats the aforementioned process, thereby preventing quality degradation caused by the thrown-in planographic printing plate 46 scratching the stacked planographic printing plate.

It should be noted that an air layer is formed along the bottom surface of the thrown-in planographic printing plate 46, the air layer raises the center portion of the planographic printing plate 46 in the aforementioned stacking apparatus 50 and the ends of the planographic printing plate 46 may be in contact with the surface of the planographic printing plate stacked on the stacking surface. In that case, a pressing device is preferably provided above the stacking platform for blasting air so as to press down an approximately center portion of the planographic printing plate 46 from above toward the stacking platform. As an example of the pressing device, an air nozzle is considered. The air nozzle is connected to an air source (not shown) such as a blower, compressor, or the like for supplying air. The air supplied from the air source is blasted to an approximately center portion of the planographic printing plate 46. Here, it is considered that an electromagnetic valve is provided on an air pipe connecting the air nozzle and the air source, and the electromagnetic valve is controlled such that the air pipe is opened when the planographic printing plate 46 is stacked; and the air pipe is closed when the stacking apparatus is terminated. Providing the pressing device above the stacking platform as described above can prevent air from remaining under the bottom surface of the planographic printing plate 46 when the planographic printing plate 46 is stacked, thereby further suppressing an arcuate curl raising the center portion of the planographic printing plate 46 along with the effect of the aforementioned upper side members and preventing the stacked sheet surface from being scratched.

In addition, a slit is preferably cut into the stopper plate 60 of the back member 58. The slit of the stopper plate 60 can provide a space for air to escape from under the bottom surface of the through-in planographic printing plate 46. A suction device may also be considered to be provided near the stopper plate 60. A space provided at the back side of the stacking platform (near the stopper plate 60) for air to escape from under the bottom surface of the planographic printing plate 46 or a suction device provided to absorb air can further suppress the arcuate curl raising the center portion of the planographic printing plate 46, thereby preventing the stacked sheet surface from being scratched.

The planographic printing plates 46 placed on the stacking platform 52 are stacked in layers with the front, rear, side ends thereof aligned with each other. When the number of planographic printing plates 46 on the stacking surface 54 reaches a predetermined number for one stack bundle defined by a shipping specification and the like, the planographic printing plates 46 are transshipped as a stack bundle 102 from the stacking apparatus 50 to a pallet or the like, and are conveyed to packaging and shipping processes or a storage warehouse or the like.

It should be noted that the present invention is described focusing on a planographic printing plate, but other sheet can also be used therefor. As described above, according to the stacking apparatus in accordance with the present invention, a thrown-in sheet is received by tapered portions of the upper side member. Then, the distance between both upper side members is extended to or more than the sheet width. Thereby, the sheet drops onto the stacking platform in a state where a center portion of the sheet becomes concave with respect to the stacking surface while both end portions thereof are supported by the tapered portions. Therefore, the sheet end portions do not droop downward, and the drop velocity of the dropping sheet can be suppressed. Accordingly, the present invention can prevent the sheet ends from scratching the surface of the sheet stacked on the stacking surface.

In addition, the present invention is described focusing on the case where sheets to which slip sheets are attached are stacked; however, the present invention can be applied even where sheets without a slip sheet are stacked.

What is claimed is:

1. A sheet stacking apparatus for positioning each of a plurality of sheets sequentially thrown in from a conveying device at a predetermined stacking position and stacking the sheets in layers, the sheet stacking apparatus comprising:

a stacking platform having a stacking surface on which the sheet thrown in from the conveying device is placed and a plurality of the sheets are stacked;

a front member which is provided at the conveying device side of the stacking platform and is provided with an air blowing device for forming an airflow in the sheet conveying direction under the sheet thrown in from the conveying device;

a back member which is provided at a back side of the stacking platform, comes in contact with a front end of the sheet thrown in from the conveying device, and receives the sheet so as to be stacked on the stacking platform; and a pair of side members provided facing each other outside the stacking platform in a width direction thereof;

wherein the pair of side members are provided with:

a pair of lower side members which is provided with an approximately same distance therebetween as the sheet width and limits a movement in the sheet width direction;

a pair of upper side members which is provided above the pair of lower side members, each of which is provided with a movable section movable in the sheet width direction, and on which tapered surfaces are formed facing each other in a generally V shape; and a control device which controls a distance between the pair of upper side members by driving the movable sections of the pair of upper side members so that, immediately after a sheet is thrown in from the conveying device, the distance between the lower ends of the pair of tapered surfaces becomes narrower than the sheet width, the distance between the pair of upper side members gradually extends as the sheet advances in a direction toward the back member, and the distance between the lower ends of the pair of tapered surfaces becomes wider than the sheet width when the sheet advances immediately before being in contact with the back member.

2. The sheet stacking apparatus according to claim 1, wherein the tapered surfaces of the upper side member are inclined at an angle ranging from 25° or more to less than 65° with respect to the horizontal surface.

3. The sheet stacking apparatus according to claim 1, wherein the pair of lower side members has pawl members capable of projecting and retracting in the horizontal direction provided facing each other above the stacking surface.

4. The sheet stacking apparatus according to claim 1, further comprising a pressing device which is provided above the stacking platform and blows air for pressing an approximately center portion of the sheet from above to the stacking platform side.

5. The sheet stacking apparatus according to claim 1, wherein the back member is formed in a slit shape for venting the airflow from the air blowing device.

6. The sheet stacking apparatus according to claim 1, further comprising a suction device which is provided near the back member at the back side of the stacking platform and absorbs the airflow from the air blowing device.

7. The sheet stacking apparatus according to claim 1, wherein the sheet is a planographic printing plate.

8. A sheet stacking method for positioning each of a plurality of sheets sequentially thrown in from a conveying device at a predetermined stacking position and stacking the sheets in layers using a sheet stacking apparatus, which includes a stacking platform having a stacking surface on which the sheet thrown in from the conveying device is placed and a plurality of the sheets are stacked, a front member which is provided at the conveying device side of the stacking platform with an air blowing device for forming an airflow in the sheet conveying direction under the sheet thrown in from the conveying device, a back member which is provided at a back side of the stacking platform, to come in contact with a front end of the sheet thrown in from the conveying device, and receive the sheet to be stacked on the stacking platform, and a pair of side members provided facing each other outside the stacking platform in a width direction of the stacking platform, wherein the pair of side members is provided with a pair of lower side members which is provided with an approximately same distance therebetween as the sheet width and limits a movement in the sheet width direction, a pair of upper side members which is provided above the pair of lower side members, each of which is provided with a movable section movable in the sheet width direction, and on which tapered surfaces are formed facing each other in a generally V shape, and a control device which controls a distance between the pair of upper side members by driving the movable sections of the pair of upper side members, the method comprising stacking sheets in the layers on the stacking surface of the stacking platform by repeating:

a first step of controlling the distance between the pair of upper side members so that, immediately after a sheet is thrown in from the conveying device, the distance between the lower ends of the pair of tapered surfaces is narrower than the sheet width, and placing the thrown-in sheet between the pair of tapered surfaces;

a second step of controlling the distance between the pair of upper side members so as to be gradually extended as the sheet advances in a direction toward the back member by the inertia of the thrown-in sheet and the airflow from the air blowing device, and allowing a center portion of the sheet placed between the pair of tapered surfaces to be bent downward by its own weight; and a third step of controlling the distance between the lower ends of the pair of tapered surfaces so that the distance becomes wider than the sheet width when the sheet advances immediately before being in contact with the back member, and dropping the sheet.

9. The sheet stacking method according to claim 8, further comprises a fourth step of projecting the pawl members facing each other from the pair of lower side members before the sheet is dropped and stacked in the third step; receiving the dropping sheet; retracting the pawl members; and dropping the sheet again onto the stacking surface.

10. The sheet stacking method according to claim 8, wherein the third step uses a suction operation by a suction device as well for absorbing the airflow from the air blowing device.

* * * * *